US009745946B2

(12) United States Patent
Maier et al.

(10) Patent No.: US 9,745,946 B2
(45) Date of Patent: Aug. 29, 2017

(54) DEVICE FOR CONTROLLING A MULTIPLE SPARK OPERATION OF AN INTERNAL COMBUSTION ENGINE, AND RELATED METHOD

(75) Inventors: Mario Maier, Kornwestheim (DE); Bernhard Opitz, Leonberg (DE); Hartwig Senftleben, Kierspe (DE); Bernd Hilgenberg, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 1370 days.

(21) Appl. No.: 12/739,918

(22) PCT Filed: Sep. 11, 2008

(86) PCT No.: PCT/EP2008/062094

§ 371 (c)(1),
(2), (4) Date: Jul. 21, 2011

(87) PCT Pub. No.: WO2009/053162

PCT Pub. Date: Apr. 30, 2009

(65) Prior Publication Data

US 2011/0270506 A1 Nov. 3, 2011

(30) Foreign Application Priority Data

Oct. 26, 2007 (DE) ..... 10 2007 051 249

(51) Int. Cl.

| | |
|---|---|
| ***F02D 28/00*** | (2006.01) |
| ***F02P 15/08*** | (2006.01) |
| ***F02P 3/05*** | (2006.01) |
| *F02P 9/00* | (2006.01) |
| *F02P 15/10* | (2006.01) |

(52) U.S. Cl.

CPC ..... *F02P 15/08* (2013.01); *F02P 3/051* (2013.01); *F02P 9/002* (2013.01); *F02P 15/10* (2013.01)

(58) Field of Classification Search

CPC ..... F02P 3/04–3/0442; F02P 3/045–3/0456; F02P 3/05–3/053; F02P 5/1502; F02P 9/002; F02P 15/08; F02P 15/10; F02P 17/10; F02P 17/12

USPC ..... 123/606, 609, 620, 627, 636, 637, 644; 701/102

See application file for complete search history.

(56) References Cited

U.S. PATENT DOCUMENTS

| | | | | |
|---|---|---|---|---|
| 6,123,057 | A * | 9/2000 | Goras et al. | 123/406.2 |
| 6,213,108 | B1 * | 4/2001 | Boyer et al. | 123/595 |
| 6,283,104 | B1 | 9/2001 | Ito et al. | |
| 6,666,195 | B2 | 12/2003 | Vogel et al. | |

(Continued)

FOREIGN PATENT DOCUMENTS

| | | |
|---|---|---|
| DE | 100 03 109 | 8/2001 |
| DE | 10 2005 036975 | 2/2006 |

(Continued)

*Primary Examiner* — Mahmoud Gimie
*Assistant Examiner* — John Zaleskas
(74) *Attorney, Agent, or Firm* — Gerard A. Messina; Norton Rose Fulbright US LLP

(57) ABSTRACT

The invention relates to a device for controlling a multiple spark operation of an internal combustion engine, wherein an ignition transformer can be switched off and back on again for delivering or interrupting an ignition spark energy based on at least one current threshold. The invention proposes that the at least one current threshold be programmable.

17 Claims, 3 Drawing Sheets

(56) References Cited

U.S. PATENT DOCUMENTS

| | | | | |
|---|---|---|---|---|
| 6,675,784 | B2 * | 1/2004 | Nagase et al. | 123/603 |
| 6,694,959 | B1 * | 2/2004 | Miwa | F02P 3/053 123/637 |
| 6,814,047 | B2 * | 11/2004 | Vogel | F02D 37/02 123/295 |
| 7,121,270 | B1 | 10/2006 | Plotnikov | |
| 2002/0046745 | A1 * | 4/2002 | Nagase | F02P 3/051 123/603 |
| 2006/0021607 | A1 * | 2/2006 | Toriyama | 123/598 |
| 2007/0175461 | A1 * | 8/2007 | Wada et al. | 123/637 |
| 2007/0181110 | A1 * | 8/2007 | Toriyama et al. | 123/637 |
| 2007/0267004 | A1 * | 11/2007 | Yamauchi | 123/604 |
| 2008/0127937 | A1 * | 6/2008 | Toriyama et al. | 123/406.12 |
| 2010/0307468 | A1 * | 12/2010 | Puettmann | F02P 3/0414 123/636 |
| 2011/0144881 | A1 * | 6/2011 | Glugla | F02P 15/08 701/102 |

FOREIGN PATENT DOCUMENTS

| | | | |
|---|---|---|---|
| JP | 2002250265 A | * | 9/2002 |
| WO | WO 02/02923 | | 1/2002 |

* cited by examiner

DEVICE FOR CONTROLLING A MULTIPLE SPARK OPERATION OF AN INTERNAL COMBUSTION ENGINE, AND RELATED METHOD

This application is a National Stage Application of PCT/EP2008/062094, filed 11 Sep. 2008, which claims benefit of Serial No. 10 2007 051 249.1, filed 26 Oct. 2007 in Germany and which applications are incorporated herein by reference. To the extent appropriate, a claim of priority is made to each of the above disclosed applications.

BACKGROUND

A device and a procedure for regulating a multiple spark operation of a combustion engine of the type that is mentioned above are generally known. In order to ensure a secure ignition of a mixture of fuel and air in all operating points of the combustion engine further ignition sparks are created in the same ignition cycle in the sense of a multiple ignition with the aid of an ignition plug in some operating statuses, such as during a starting phase, by turning back on an ignition transformer immediately after one ignition spark dies. With the aid of a device a controlling of the multiple spark ignition takes place.

Further solutions are known, which improve the multiple spark operation—also called multiple spark mode. Thereby a primary inductance that is located in the primary current circuit of the transformer is reloaded already before igniting the ignition spark. Due to a still existing residual energy in the ignition transformer a recharging time of the primary inductance is significantly reduced. In this context it can be profited from an effect, at which a significant part of the ignition spark energy that is created by the transformer is transformed at the beginning of each ignition spark, thus if the ignition spark current is the highest, whereby it subsequently sinks almost linearly. By doing so several ignition sparks of short duration but comparably high energy can be created during an ignition cycle. The device provides thereby merely the total duration of the multiple spark operation, while a regulator electronic takes over a regulation of the multiple spark operation, thus a series of consecutive ignition sparks. The regulator electronic is usually located together with the ignition transformer in a common housing.

Typically firm threshold values are stored in the regulator electronic for a primary current and for a secondary current, at which the ignition transformer is turned off and back on. But there are several influencing factors, such as the composition of a fuel air mixture, ignition plug ageing and such alike, which complicate an optimal operation of the combustion engine at specified threshold values.

SUMMARY

According to the invention for regulating a multiple spark operation of a combustion engine, an individual adjustment of the threshold values, in particular the current thresholds, can be carried out for the primary current and/or for the secondary current depending on the operating status of the combustion engine. Thereby a programming of at least one current threshold takes place. The individual adjustment of the current thresholds enables therefore a demand-oriented adjustment of the follow-up current thresholds of the multiple spark operation in each single cylinder or work cycle of the combustion engine.

With the aid of the individual adjustment of the current threshold and the corresponding demand-oriented adjustment of the follow-up current thresholds of the multiple spark operation influencing factors, as for example the mixture composition, ignition plug ageing and such alike, which complicate the optimal operation of the combustion engine, can therefore be considered and compensated at ignition processes. With other words the feed of ignition energy to an ignition plug can be adjusted to the demand of the corresponding operating and load status of the combustion engine.

Lastly the present invention does not only ensure an improved fuel ignition but also a reliable operation of the combustion engine. Additionally the improved fuel ignition has a positive effect on a fuel consumption of the combustion engine on the one hand and on a power request of the combustion engine on the other hand. The same applies analogously for the procedure for regulating the multiple spark operation of a combustion engine.

According to a preferred embodiment of the invention it is provided that an adjustment of the at least one current threshold takes place depending on a transformer current, in particular a primary current and/or secondary current, that can be detected with a detection device or measured. An individual adjustment of the thresholds can thereby take place with the aid of a control unit in such a way that they are brought into accordance with the optimal thresholds, which are known for each operating status and stored in the control unit. Ultimately the multiple spark operation is enabled by this means, in particular including the adjusted thresholds.

It is provided in an advantageous embodiment of the invention that a transmission of the default value for a follow-up current threshold takes place from a control unit to a regulator electronic of the ignition transformer with the aid of an encoded interval between a first control signal that is emitted by a control unit and a second control signal that is emitted by the control unit. By means of the coding of the interval or the pause time between the two control signals of the control unit an information that qualifies for the ignition transformer can be transmitted over a provided current threshold It is provided in a further advantageous embodiment of the invention that the transmission of the default value for the follow-up current threshold, in particular the secondary current switch-off threshold, takes place by means of the duration of the interval. The duration of the interval or the pause time between the two control signals of the control unit represents a signal gap, which is present anyway and which can be used by a targeted and scheduled change to a value association. Thus an interval of for example 30 μs can be associated with a secondary current switch-off threshold of 70 mA or an interval of 160 μs with secondary current switch-off threshold of 40 mA.

According to a preferred embodiment of the invention it is provided that the transmission of the default value takes place by means of the duration of the interval in combination with a further default value for a corresponding follow-up current threshold, in particular a primary current switch-off threshold, which is based on an additional current threshold. That results in a synergy effect, at which a value combination can be transmitted for the secondary current switch-off threshold as well as for the primary current switch-off threshold by means of only one parameter namely the interval.

According to a preferred embodiment of the invention it is provided that the transmission of the default value takes place in connection with a current threshold difference value over the duration of the interval. With other words a value delta is thereby transmitted over the pulse pause, which lowers the corresponding current threshold at a longer pulse pause for example by 10 mA. At a short pulse pause the corresponding current threshold can be raised with the aid of the value delta for example by 10 mA. A constellation can also be provided, at which an average pulse pause causes no change of the relevant current threshold.

It is provided in a preferred embodiment of the invention that a bidirectional interface is provided between the control unit and the ignition transformer, in particular for transmitting a spark burning time. A feedback of information of the ignition transformer can thereby take place by a switchover of a control current. The control current during the spark burning time can for example correspond with a value of 20 mA and during the loading phase with a value of 10 mA. The control unit is then able to determine the spark burning time over the current and increases or reduces the secondary current threshold depending on the required spark burning time. Ultimately an erroneous interpretation of present pulse pauses, in particular during the transmission of current threshold difference values, can be thereby avoided. Furthermore it is ensured that the information in the control unit and in the ignition transformer always correspond, whereby an error is not carried along in each further ignition cycle.

It is provided in a further advantageous embodiment of the invention that the transmission of the default value and/or the further default value takes place with the aid of a protocol that contains current threshold values over the duration of the interval. The protocol comprises thereby rules, which determine the format, the contents, the meaning and the order of sent information between different instances, in particular between the regulator electronic that is located in the ignition transformer and the ignition transformer itself or between the control unit and the regulator electronic.

According to a preferred embodiment of the invention it is provided that a detection of an amplitude value of a first primary current pulse takes place for adjusting the at least one current threshold, in particular the primary current switch-off threshold. The amplitude of the first primary current pulse is therefore used to adjust or program the primary current threshold. The amplitude value of the first pulse corresponds thereby with the current threshold for all subsequent pulses. Alternatively the current threshold can be increased or reduced by a firm factor.

According to a preferred embodiment of the invention it is provided that the transmission of the default value of the secondary current switch-off threshold takes place over the duration of the interval during the detection of the amplitude value of the first primary current pulse for adjusting the primary current switch-off threshold. The amplitude value is thereby used as default for all further primary current switch-off thresholds and simultaneously transmitted over the pause of the secondary current threshold. Advantageous is also an embodiment of the invention, which provides that the transmission of a combination of the secondary current switch-off threshold and primary current switch-off threshold takes place with the amplitude respecting the amplitude value of the first primary current. Thereby a firm value combination results from the threshold value, whereby the pause remains disregarded. An amplitude of 15 A can for example be associated with a value combination of 15 A for the primary current switch-off threshold and of 40 mA for the secondary current switch-off threshold. Furthermore the switch-off threshold for the primary current can lie at 16 A and the switch-off threshold for the secondary current at 50 mA at an amplitude of 16 A. at a switch-off threshold of 17 A for the primary current and a switch-off threshold of 60 mA for the secondary current the amplitude can have a value of 17 A.

It is provided in an advantageous embodiment of the invention that the control unit adjusts the duration of the interval depending on the operating status of the combustion engine, whereby a measurement and storage of the upcoming secondary current value takes place at the end of the interval, which serves as default value of the corresponding follow-up current threshold, in particular the secondary current threshold, whereby a further alternative to the previously mentioned value defaults is given.

It is provided in a further advantageous embodiment of the invention that the transmission of the default value and/or the further default value takes place over the duration of the second control signal with the aid of a protocol that contains current threshold values or with the aid of a value signal that contains the current threshold values, in particular a pulse width modulated value signal. For transmitting the corresponding information during the multiple spark phase a protocol has to be provided that is suitable for single-wire interfaces or also a suitable pulse width modulated signal. In order to avoid an undesired switching on or switching off of the ignition transformer due to the information transmission very short pauses can be used, which can be preferably filtered for a standard function. The sent information are processed for this case not until the next ignition cycle.

BRIEF DESCRIPTION OF THE DRAWINGS

The invention as well as advantageous embodiments according to the characteristics of the further claims are subsequently further explained with the aid of the embodiments that are illustrated in the drawings, without a limitation of the invention; it comprises furthermore all variations, changes and equivalents, which are possible within the scope of the claims. It is shown in:

DETAILED DESCRIPTION

Figure 1:
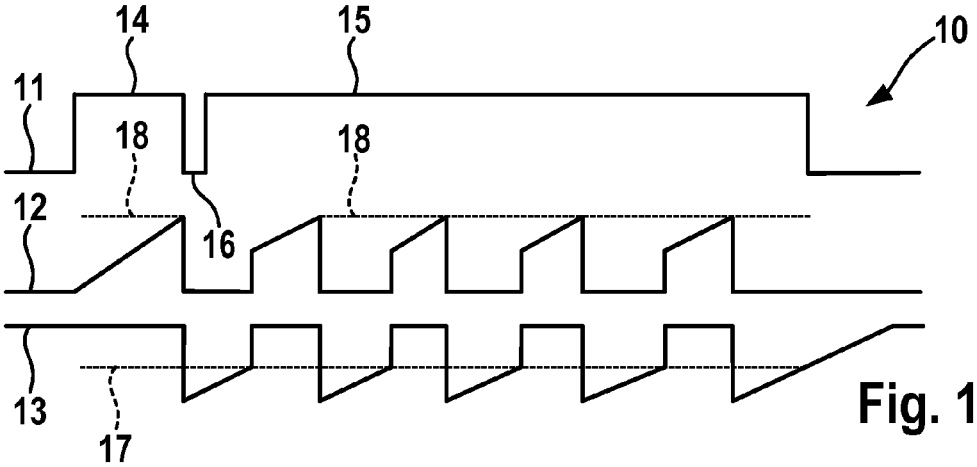
FIG. 1 a diagram with a control signal course, in particular the course of a control voltage, as well as with a primary current course and with a secondary current course, at which the adjustment of the secondary current switch-off threshold takes place over a short pulse pause.

FIG. 1 shows a diagram 10, which comprises the course of a control voltage 11, the course of a primary current 12 as well as the course of a secondary current 13. At a multiple spark system of the present type a control unit typically sends out a first pulse 14 and a second pulse 15 at the use of a single-wire interface in an ignition cycle. The first pulse 14 corresponds with a conventional transistor coil ignition, whereby the control unit provides a loading time as well as an ignition time. The second pulse 15 provides the duration of a multiple spark phase. There is a pulse pause 16 or also an interval between the two pulses 14, 15—also called control signals, which is relatively short according to FIG. 1 and which serves for programming at least one of the current thresholds. As long as the pause time 16 is encoded between the two pulses 14, 15 that are sent out by the control unit, information or data values, such as values of a secondary current threshold 17, can be transmitted over the pulse pause 16 to the ignition transformer, in particular ignition coil. The encoding can thereby take place by different variants.

Figure 2:
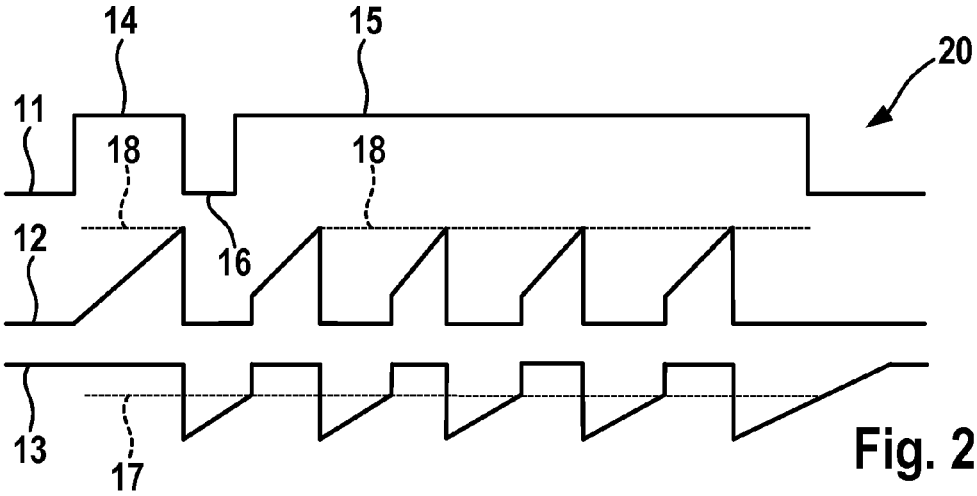
FIG. 2 a further diagram with a control signal course, in particular the course of a control voltage, as well as with a primary current course and with a secondary current course, at which the adjustment of the secondary current switch-off threshold takes place over a long pulse pause.

According to FIG. 1 a transmission of values of the secondary current switch-off threshold 17 takes place over the duration or length of the pulse pause 16. In the present embodiment the pulse pause 16 has a value of 10 μs and corresponds therefore with a secondary current switch-off threshold 17 of 80 mA, which is equivalent to a high switch-off current. Besides the secondary current switch-off threshold 17 there is a primary current switch-off threshold 18. At additional pairs of values the pulse duration 16 provides values of 30 μs, 60 μs, 100 μs or 160 μs, while the secondary current switch-off threshold 17 is set to values of 70 mA, 60 mA, 50 mA or 40 mA. According to FIG. 2 or according to a corresponding diagram 20 the secondary current switch-off threshold 17 corresponds with the lastly mentioned value of 40 mA of the pulse pause 16 at 160 μs, which mirrors a low switch-off current at a comparably long pulse pause. Apart from that the diagram according to FIG. 2 corresponds with the diagram according to FIG. 1 and provides also the course of the control signal 11, the course of the primary current 12 with a corresponding primary current switch-off threshold 18 as well as the course of the secondary current 13.

Figure 3:
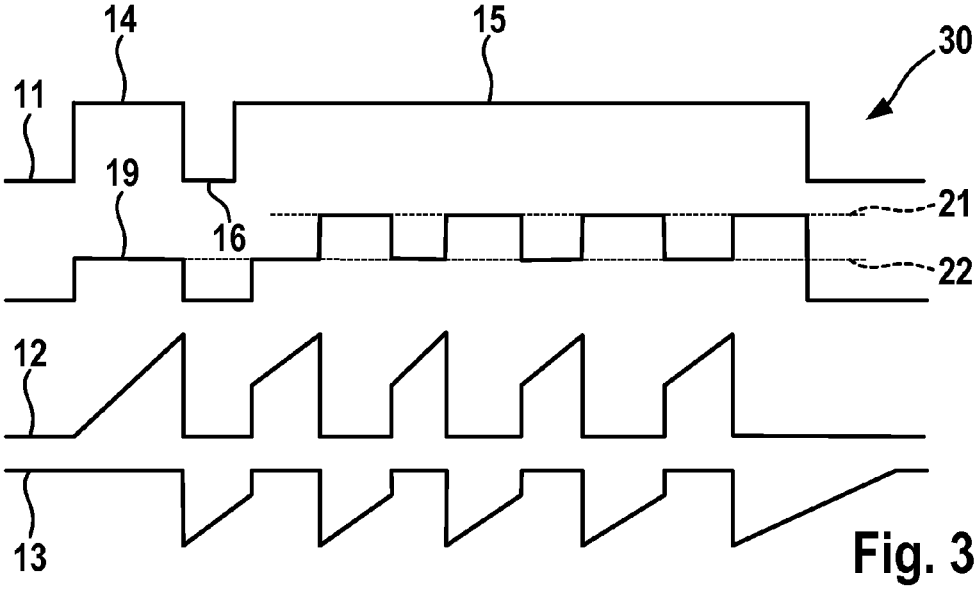
FIG. 3 a diagram with a control signal course, in particular a course of a control voltage, and with a course of a control current as well as with a primary current course and with a secondary current course, at which a change of the control current takes place by a regulator electronic of an ignition transformers depending on the operating status of the transformer (reloading=20 mA and unloading (ignition spark)=10 mA)

FIG. 3 shows a diagram 30, which describes the course of the control voltage 11, the course of the control current 19 as well as the course of the primary current 12 and the course of the secondary current 13. A current threshold difference value or also a value delta is thereby transmitted over the pulse pause 16. A long pulse pause means in that context a sinking of the current threshold by 10 mA. A short pulse pause causes an increase of the current threshold by 10 mA. In order to avoid an erroneous interpretation of present pulse pauses, in particular at the transmission of current threshold difference values, a bidirectional interface can be provided between the control unit and ignition transformer. A feedback of information of the ignition transformer can thereby take place by a switchover of a control current. The control current 19 can for example correspond with a value 21 of 20 mA during a spark burning time and with a value 22 of 10 mA during a reloading phase. The control unit is able to determine the spark burning time over the current and increases or reduces the secondary current threshold depending on the required spark burning time. It is thereby ensured that the information in the control unit and in the ignition transformer do always correspond with each other, whereby an error is not carried along into every further ignition cycle.

Figure 4:
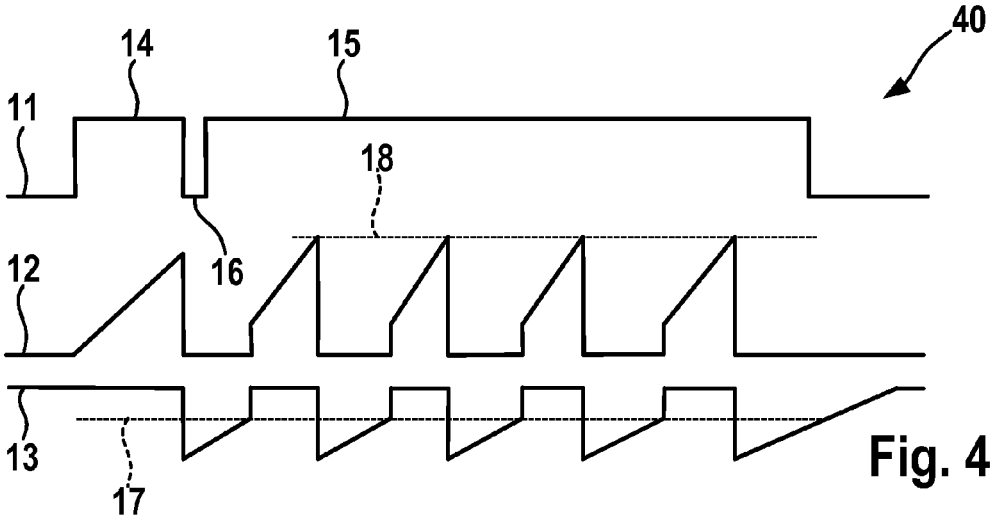
FIG. 4 a diagram with a control signal course, in particular a course of a control voltage, as well as with a primary current course and with a secondary current course, at which the adjustment of a primary and secondary current switch-off threshold, in particular with the aid of a switch-off threshold value pair takes place over a short pulse pause.
Figure 5:
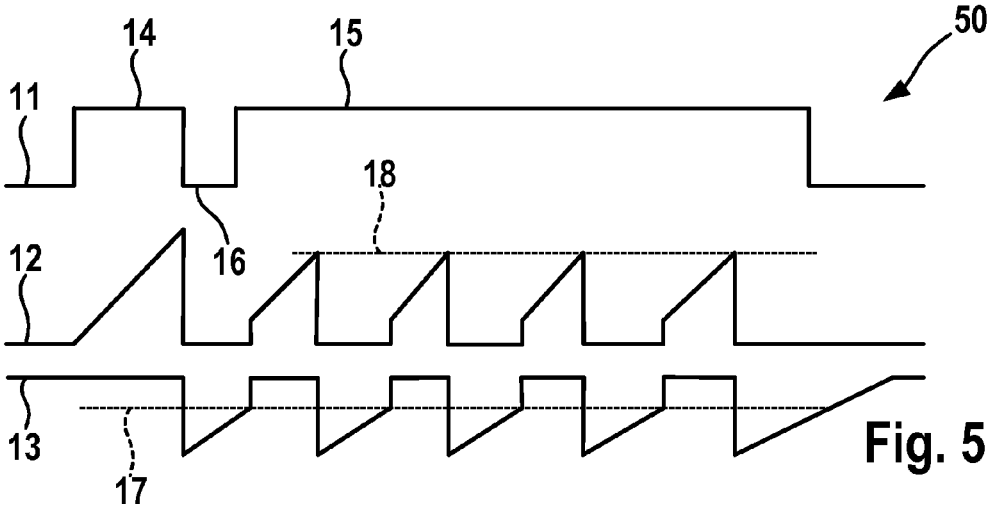
FIG. 5 a further diagram with a control signal course, in particular a course of a control voltage, as well as with a primary current course and with a secondary current course, at which the adjustment of a primary and secondary current switch-off threshold, in particular with the aid of a switch-off threshold value pair takes place over a long pulse pause.

FIG. 4 shows a diagram 40, which illustrates the course of the control voltage 11, the course of the primary current 12 as well as the course of the secondary current 13. Thereby a combination of values from the secondary current switch-off threshold 17 and the primary current switch-off threshold 18 are transmitted over the duration of the pulse pause 16. The duration of the pulse pause 16 of 160 μs corresponds thereby with 50 mA for the secondary current switch-off threshold 17, and 17A for the primary current switch-off threshold 18. According to FIG. 5, whose diagram 50 also provides the course of the control current 11, the course of the primary current 12 and the course of the secondary current 13, the duration of the pulse pause is 100 μs, so that a value of 50 mA is associated to the secondary current switch-off threshold 17 and a value of 15 A to the primary current switch-off threshold 18. Further associations provide a current threshold relation of 70 mA to 17 A for a pulse pause of 60 μs and a current threshold relation of 70 mA to 15 A at a pulse pause of 30 μs for the secondary current switch-off threshold 17 or for the primary current switch-off threshold 18.

Figure 6:
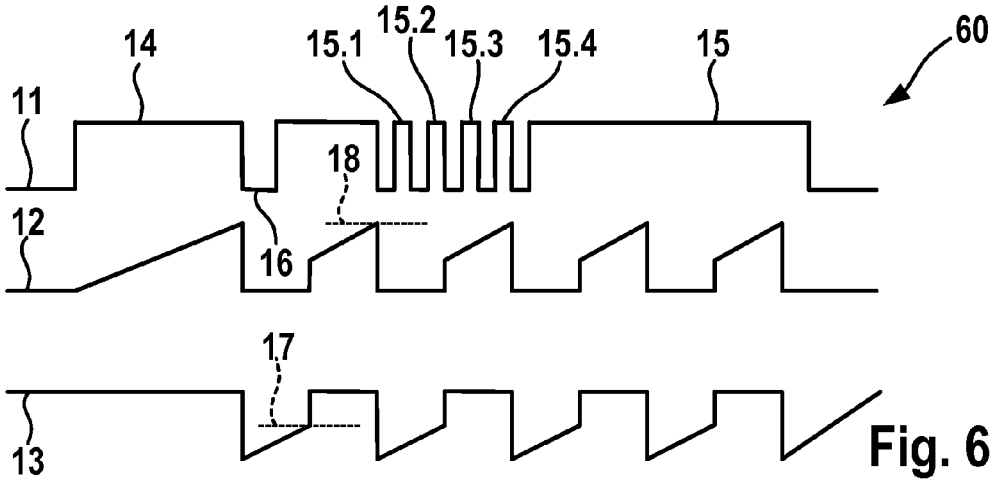
FIG. 6 a diagram with a control signal course, in particular a course of a control voltage, as well as with a primary current course and with a secondary current course, at which an information transmission takes place for adjusting the current switch-off thresholds during a multiple spark phase.
Figure 7:
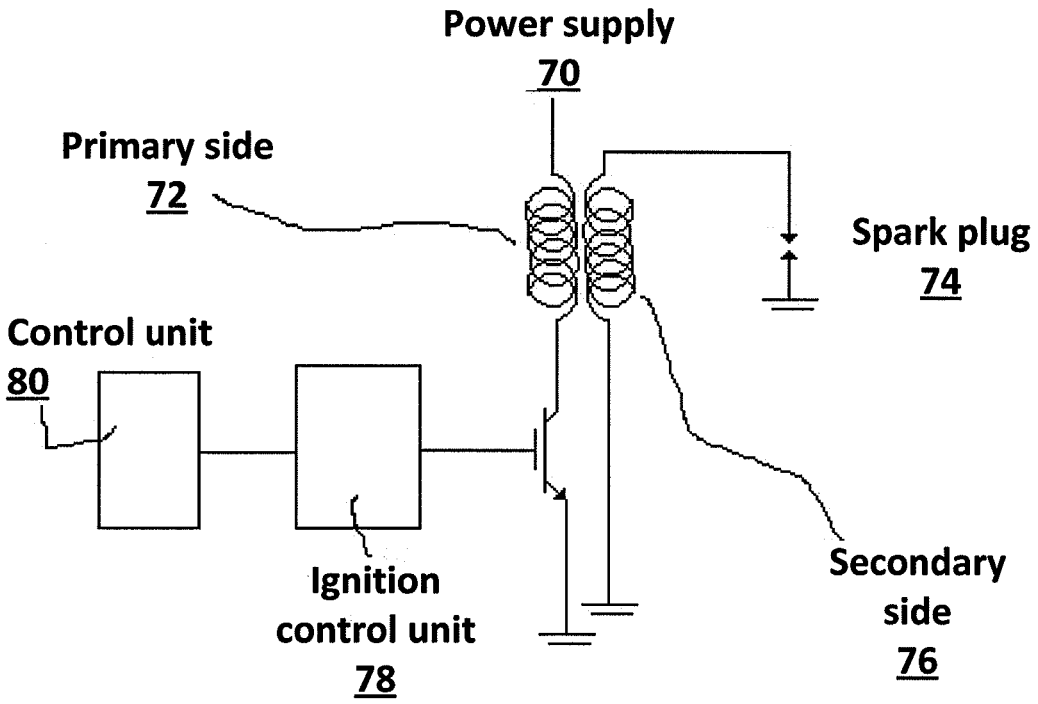
FIG. 7 shows an ignition control unit 78 connected to a control unit 80, a primary side coil 72 connected to the ignition control unit 78 and also to a power supply 70, and a secondary side coil 76 connected to a spark plug 74.

FIG. 6 shows a diagram 60, which comprises the course of the control voltage 11 as well as the course of the primary current 12 and the course of the secondary current 13. The transmission of the information about the current thresholds takes thereby place during the multiple spark phase, thus during the second pulse 15. For the transmission of the information and values a protocol can be used that is suitable for single-wire interfaces. The multiple spark phase or its signal course are thereby the basis for a programming of the current thresholds. Alternatively also a pulse width modulated signal can be used. In order to avoid an undesired switching on or switching off of the ignition transformer due to the information transmission during the multiple spark phase, preferably very short pulses 15.1 to 15.4 are used, which can be filtered for a standard function. The sent information are processed for that case not unit the next ignition cycle, since the multiple spark phase or its signals themselves serve as information carriers.

The invention claimed is:

1. A control unit for regulating a multiple spark operation of a combustion engine, comprising an ignition transformer that is switched on and off for releasing or interrupting an ignition spark current by a regulator electronic circuit for actuating the ignition transformer with the aid of at least one programmed current threshold, wherein the control unit is configured to transmit a first control signal and a second control signal to the regulator electronic circuit, the first and second control signals being separated from each other in time such that a value for a follow-up current threshold is defined by a variable pulse pause between a termination of the first control signal and a beginning of the second control signal when the first control signal and the second control signal are not being transmitted; wherein the control unit is configured to store a plurality of thresholds that correspond to a plurality of operating statuses of the combustion engine, wherein the first and second control signals are supplied to the regulator electronic circuit for defining the follow-up current threshold and for actuating the ignition transformer, wherein the first and second control signals are communicated from the control unit to the regulator electronic circuit over a single-wire interface, wherein the first control signal provides a loading time and an ignition time of a conventional ignition, and wherein the second control signal provides a duration of a multiple spark phase, wherein the variable pulse pause is an encoded interval, and wherein the value for the follow-up current threshold is transmitted over the single-wire interface via the encoded interval between the first control signal and the second control signal.

2. The control unit according to claim 1, wherein the release or interruption of the ignition spark current takes place depending on a comparison of the follow-up current threshold and a measurable transformer current, wherein the measurable transformer current is a secondary current.

3. The control unit according to claim 1, wherein a transmission of the value for the follow-up current threshold takes place depending on a duration of the variable pulse pause in combination with a further value of a related follow-up current threshold, wherein the related follow-up current threshold is a primary current switch-off threshold.

4. The control unit according to claim 3, wherein the transmission of the value for the follow-up current threshold value and/or a transmission of a further value for the follow-up current threshold takes place with the aid of a protocol which contains correlations between a duration of the variable pulse pause and the follow-up current threshold values.

5. The control unit according to claim 1, wherein a transmission of the value for the follow-up current threshold value takes place in connection with a current threshold difference value over a duration of the variable pulse pause.

6. The control unit according to claim 1, wherein a bidirectional interface is provided between the control unit and the ignition transformer, the bidirectional interface being used for transmitting a spark burning time.

7. The control unit according to claim 1, wherein a transmission of a value of a secondary current switch-off threshold over a duration of the variable pulse pause takes place during the detection of an amplitude value of a first primary current pulse for adjusting a primary current switch-off threshold.

8. The control unit according to claim 1, wherein a transmission of a combination of a secondary current switch-off threshold and a primary current switch-off threshold takes place with an amplitude of a first primary current pulse.

9. A regulator electronic circuit for an ignition transformer and for regulating a multiple spark operation of a combustion engine, comprising the ignition transformer, the ignition transformer being switched on and off for releasing or interrupting an ignition spark current by the regulator electronic circuit with the aid of at least one programmed current threshold, wherein the regulator electronic circuit is configured to receive a first control signal and a second control signal from a control unit, the first and second control signals being separated from each other in time such that a value for a follow-up current threshold is defined by a variable pulse pause between a termination of the first control signal and a beginning of the second control signal when the first control signal and the second control signal are not being transmitted; wherein the control unit is configured to associate a duration of the variable pulse pause with the follow-up current threshold, wherein the first and second control signals are supplied to the regulator electronic circuit for defining the follow-up current threshold and for actuating the ignition transformer, wherein the first and second control signals are communicated from the control unit to the regulator electronic circuit over a single-wire interface, wherein the first control signal provides a loading time and an ignition time of a conventional ignition, and wherein the second control signal provides a duration of a multiple spark phase, wherein the variable pulse pause is an encoded interval, and wherein the value for the follow-up current threshold is transmitted over the single-wire interface via the encoded interval between the first control signal and the second control signal.

10. The regulator electronic circuit according to claim 9, wherein the release or interruption of the ignition spark current takes place depending on a comparison of the follow-up current threshold and a measurable transformer current, wherein the measurable transformer current is a secondary current.

11. The regulator electronic circuit according to claim 9, wherein a transmission of the value for the follow-up current threshold takes place depending on the duration of the variable pulse pause in combination with a further value of a related follow-up current threshold, wherein the related follow-up current threshold is a primary current switch-off threshold.

12. The regulator electronic circuit according to claim 11, wherein the transmission of the value for the follow-up current threshold value and/or a transmission of a further value of the related follow-up current threshold takes place with the aid of a protocol which contains correlations between the duration of the variable pulse pause and the follow-up current threshold values.

13. The regulator electronic circuit according to claim 9, wherein a transmission of the value for the follow-up current threshold value takes place in connection with a current threshold difference value over the duration of the variable pulse pause.

14. The regulator electronic circuit according to claim 9, wherein a bidirectional interface is provided between the control unit and the ignition transformer, the bidirectional interface being used for transmitting a spark burning time.

15. The regulator electronic circuit according to claim 9, wherein a transmission of the value for the follow-up current threshold value of a secondary current switch-off threshold over a duration of the variable pulse pause takes place during the detection of an amplitude value of a first primary current pulse for adjusting a primary current switch-off threshold.

16. The regulator electronic circuit according to claim 9, wherein a transmission of a combination of a secondary current switch-off threshold and a primary current switch-off threshold takes place with an amplitude of a first primary current pulse.

17. A procedure for regulating a multiple spark operation of a combustion engine, comprising: switching an ignition transformer off and on for releasing or interrupting an ignition spark current by a regulator electronic circuit for actuating the ignition transformer with the aid of at least one current threshold, transmitting a first control signal and a second control signal to the regulator electronic circuit from a control unit, the first and second control signals being separated from each other in time, and defining a value for a follow-up current threshold using a duration of a variable pulse pause between a termination of the first control signal and a beginning of the second control signal when the first control signal and the second control signal are not being transmitted, wherein the first and second control signals are supplied to the regulator electronic circuit for defining the follow-up current threshold and for actuating the ignition transformer, wherein the first and second control signals are communicated from the control unit to the regulator electronic circuit over a single-wire interface, wherein the first control signal provides a loading time and an ignition time of a conventional ignition, and wherein the second control signal provides a duration of a multiple spark phase, wherein the variable pulse pause is an encoded interval, and wherein the value for the follow-up current threshold is transmitted over the single-wire interface via the encoded interval between the first control signal and the second control signal.

* * * * *